United States Patent [19]

Garrison et al.

[11] 4,106,277

[45] Aug. 15, 1978

[54] WRISTWATCH SETTING SYSTEM

[75] Inventors: Donald W. Garrison, Lancaster; James T. Hartman, Reading, both of Pa.

[73] Assignee: Time Computer, Inc., Lancaster, Pa.

[21] Appl. No.: 771,096

[22] Filed: Feb. 23, 1977

[51] Int. Cl.[2] ..... G04B 19/24; G04B 27/00; G04C 19/00

[52] U.S. Cl. ..... 58/4 A; 58/23 R; 58/50 R; 58/58; 58/85.5

[58] Field of Search ..... 58/4 A, 23 R, 50 R, 58/58, 85.5

[56] References Cited

U.S. PATENT DOCUMENTS 3,953,964 5/1976 Suppa et al. ..... 58/50 R

*Primary Examiner*—Stanley J. Witkowski

*Attorney, Agent, or Firm*—LeBlanc & Shur

[57] ABSTRACT

A multi-function LED wristwatch in which all the required functions may be performed with the use of only two push button switches. These switches are time demand for displaying hours, minutes and seconds and date demand for alternatively displaying day of month, month of year, AM or PM of time, and day of week. They also perform all the setting functions for these displays and through sequential button depression and digital logic circuits, five of the functions, namely hours, minutes, day of the month, month of the year, and day of the week may be set independently.

20 Claims, 9 Drawing Figures

FIG. 6
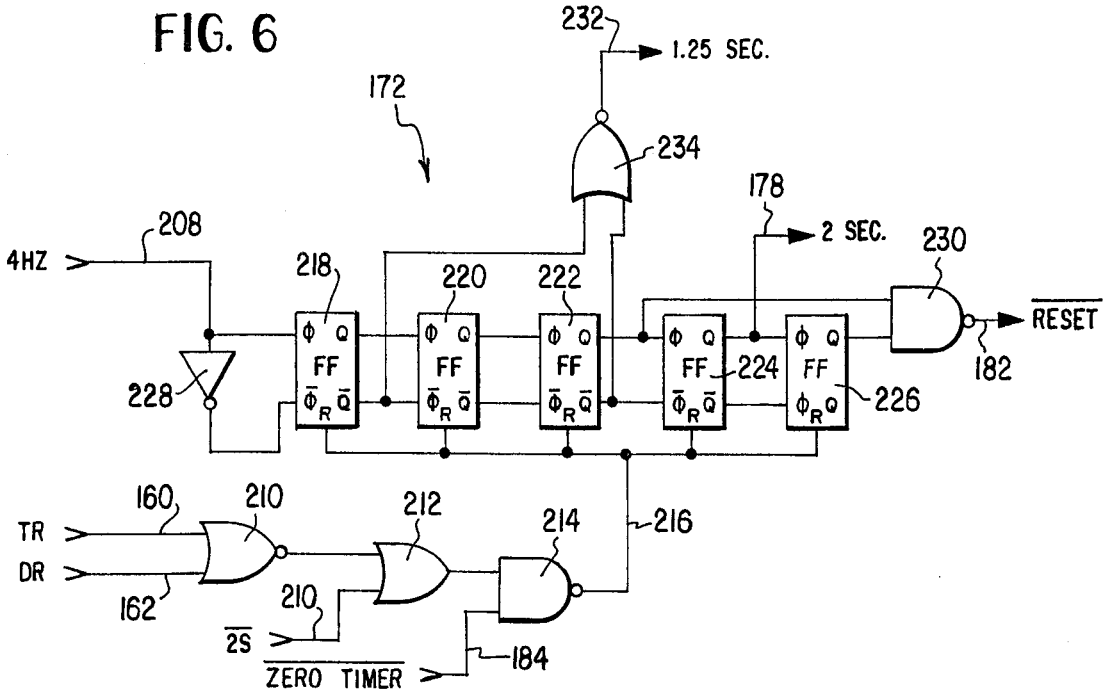
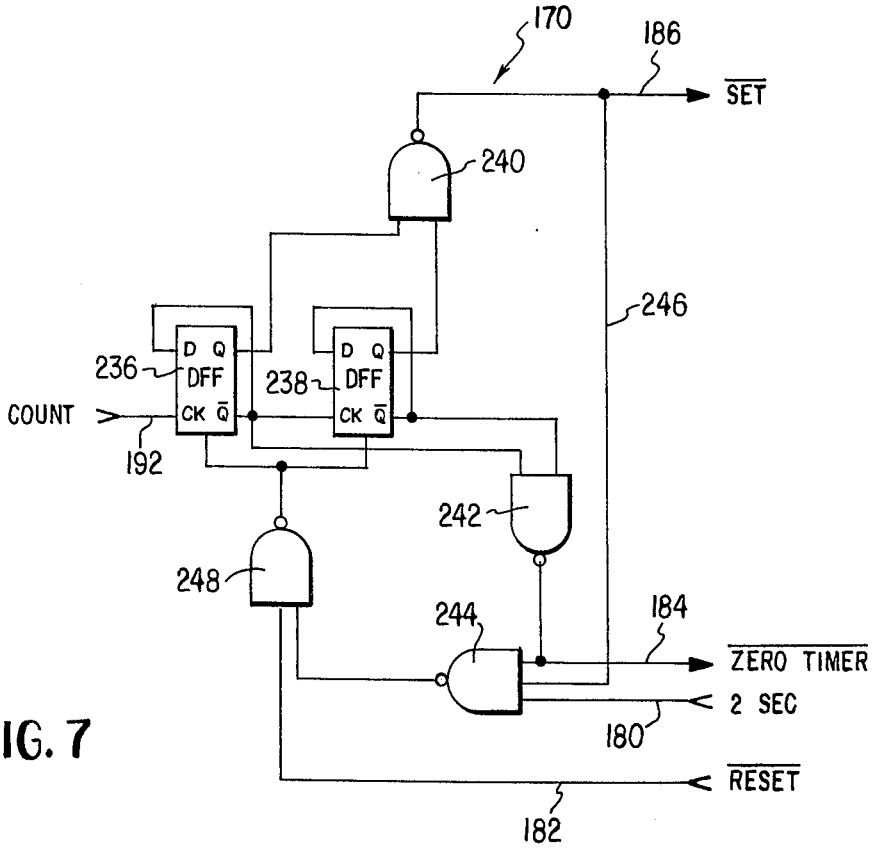
FIG. 7

WRISTWATCH SETTING SYSTEM

This invention relates to a solid state wristwatch having an active display and more particularly to an improved light emitting diode wristwatch setting system which eliminates the necessity for separate setting switches commonly referred to as the hour set and minute set switches.

Battery powered wristwatches and other small portable timekeeping devices of various types are well known and are commercially available. The first battery powered wristwatch to be successfully marketed was of the electro-mechanical type shown and described in U.S. Pat. No. Re. 24,187 reissued Apr. 4, 1967 to John A. Van Horn et al for ELECTRONIC WATCH.

In recent years considerable effort has been directed toward the development of a wristwatch which does not employ an electro-mechanical oscillator as the master time reference. For example, in assignee's U.S. Pat. No. 3,560,998, issued Feb. 2, 1971, there is shown a wristwatch in which the master time reference is formed by a high frequency oscillator connected to the watch display through a divider formed of low power complementary MOS transistor circuits. In assignee's U.S. Pat. No. 3,576,099, issued Apr. 27, 1971, there is disclosed a watch construction in which the optical display is described as a plurality of light emitting diodes which are intermittently energized to assure minimum power consumption and an increasingly long life for the watch battery. Improved watch constructions of this general type incorporating solid state circuits and integrated circuit techniques are disclosed in assignee's U.S. Pat. Nos. 3,672,155; 3,760,584; 3,742,699; 3,759,031; and others.

As disclosed for example in assignee's U.S. Pat. Nos. 3,782,102 and 3,803,827, these watches have employed four magnetic reed switches to control both the time and calendar operation of the watch. These have taken the form of a pair of magnetic push buttons forming respective time and calendar display demand switches. The other two magnetic reed switches commonly referred to as the hours and minutes setting switches (although they were also used for date setting) were actuated by manually placing a permanent magnet in a proper indentation provided in the back plate of the wristwatch. This permanent magnet was, when not in use, carried in a suitable compartment forming a part of the clasp of the watch bracelet. Although the magnetic setting feature is highly desirable in that it avoids penetration of the watch case with the accompanying sealing problems, it does necessitate a separate permanent magnet and compartment from which the magnet may be lost and calls for a certain amount of manual dexterity involved in removing the magnet from its compartment and inserting it into the proper setting indentation.

The present invention is directed to an improved wristwatch construction of the same general type as disclosed in the above-mentioned patents, but one which employs a simplified setting circuit which eliminates the need for the two setting reed switches and the separate magnet and carrying compartment along with the inconveniences attendant to them. In the present invention, setting is accomplished solely by the use of two push buttons, namely, the time read demand button and the date read (or display) demand button. This setting is accomplished while the time piece remains on the wearer's wrist and each function of the wristwatch is set independently. Month and date settings are initiated with the upper command button whereas hours, minutes, and seconds with the lower command button or time display button.

There are two general setting modes for changing the time and date readings in the watch of this invention. These are TIME SET which is used for setting the minutes and/or hours and DATE SET which is used for setting days and/or months.

The TIME SET mode is generated by applying a time read input three successive times to the watch circuit within a two second interval. The watch circuit indicates this setting mode by displaying the hour and minutes continuously while in the TIME SET mode. Minutes may then be advanced by maintaining the time read input and hours may be advanced by maintaining the date read input. The circuit will automatically vacate the TIME SET mode at the end of any 5 second interval during which no time read or date read input has been received. Upon leaving the setting mode the circuit reverts to the normal operating mode.

The DATE SET mode is generated by applying a date read input three successive times to the watch circuit within a two second interval. The watch circuit indicates this setting mode by displaying the month and day continuously while in the DATE SET mode. Days may then be advanced by maintaining the time read input and months may be advanced by maintaining the date read input. The circuit will automatically vacate the DATE SET mode at the end of any 5 second interval during which no time read or date read input has been received. Upon leaving the setting mode, the circuit will revert to the normal operating mode.

It is therefore one object of the present invention to provide an improved solid state wristwatch.

Another object of the present invention is to provide an improved solid state wristwatch having a light emitting diode display.

Another object of the present invention is to provide a solid state wristwatch having an improved setting system.

Another object of the present invention is to provide a wristwatch with an active display for both time and calendar functions in which all display and settings may be accomplished by using only two switches.

Another object of the present invention is to provide a setting system for a solid state wristwatch in which setting is accomplished by using the same two magnetic push buttons which are used for time and calendar display demand.

Another object of the present invention is to provide a solid state wristwatch in which setting is accomplished as a result of a sequence of push button depressions within a predetermined time.

These and further objects and advantages of the present invention will be more apparent upon reference to the following specification, claims and appended drawings wherein:

FIG. 6 is a detailed logic diagram of the two and five second timer of FIG. 5;

FIG. 7 is a detailed logic diagram of the set mode counter of FIG. 5;

Figure 1:
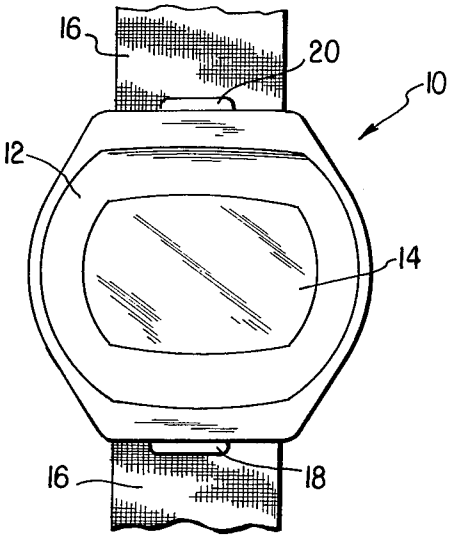
FIG. 1 is a plan view of a wristwatch and a portion of a wristwatch bracelet constructed in accordance with the present invention.

Referring to the drawings, FIG. 1 is a top plan view of a wristwatch constructed in accordance with the present invention. The watch generally indicated at 10 comprises a non-magnetic watch case 12 having a viewing window 14. The window is preferably formed by a suitable red light filter such as a transparent red plastic, glass, or ruby material. Attached to case 12 is wristwatch bracelet 16 and mounted on the case is a push button time demand switch 18. Also mounted on the watch case at the edge opposite from the time demand switch 18 is a similar date demand switch 20. Push button switches 18 and 20 are preferably of identical construction and carry permanent magnets so that when they are depressed, reed switches inside the watch case are actuated. They are preferably constructed in the manner illustrated in assignee's U.S. Pat. No. 3,921,108, the disclosure of which is incorporated herein by reference, but if desired may be constructed as shown in assignee's U.S. Pat. No. 3,782,102.

Wristwatches of the type shown in FIG. 1 are well known and are sold by applicant's assignee under the trademark PULSAR. Briefly, the wristwatch comprises a time base or frequency standard in the form of a crystal oscillator operating at a frequency of 32,768 Hz. This relatively high frequency is supplied to a frequency divider which divides down the frequency from the standard to one Hz. This signal is supplied to a display actuator which in turn drives a light emitting diode display viewable through the window 14 of FIG. 1. When push button 18 is depressed only an hours and minutes display appears. These remain for a predetermined time and if the push button 18 remains depressed the hours and minutes are extinguished and the seconds become visible. The same display diodes are used for both minutes and seconds since these are not displayed simultaneously, thus minimizing the power drain from the watch battery.

Figure 2:
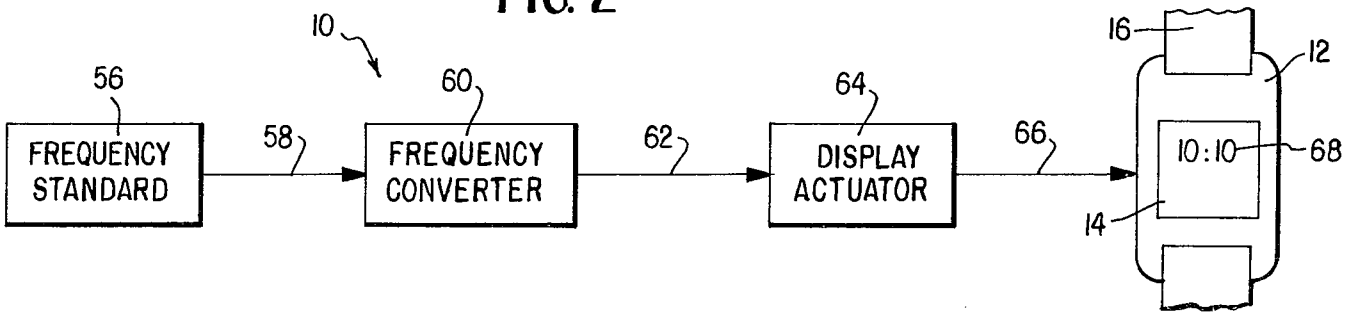
FIG. 2 is a simplified block diagram of the wristwatch of FIG. 1.

FIG. 2 is a simplified block diagram of the principal timekeeping components of the watch of the present invention. These comprise a time base of frequency standard 56, preferably in the form of a crystal oscillator producing an electrical output on lead 58 at a frequency of 32,768 Hz. This relatively high frequency is supplied to a frequency converter 60 in the form of a divider which divides down the frequency from the standard 56 so that the output from the converter 60 appearing on lead 62 is at a frequency of 1 Hz. This signal is supplied to a display actuator 64 which in turn drives an electro-optical display indicated at 68 and viewable through window 14 by way of electrical lead 66. While only an hours and minutes display is shown, it is understood that with the operation of the push button 18 of FIG. 1, the hours and minutes are first displayed for a predetermined time and if the push button remains depressed, the hours and minutes are extinguished and the seconds become visible. The same display diodes are used for both minutes and seconds since these are not displayed simultaneously, thus minimizing the power drain from the watch battery.

In normal operation, time is continuously being kept but is not displayed through the window 14. That is, no indication is visible through the window and this is the normal condition which prevails in order to conserve battery energy in the watch. However, even though the time is not displayed through the window 14, it is understood that the watch continuously keeps accurate time and is capable of displaying this time at any instant. When the wearer or operator desires to ascertain the correct time, he depresses the push button 18 with his finger and the correct time is immediately displayed through window 14 giving the correct time reading such as 10:10, namely 10 minutes after 10 o'clock. The hours and minutes are displayed through the window 14 for a predetermined length of time, preferably $1\frac{1}{4}$ seconds, irrespective of whether or not the push button 18 remains depressed. The exact time of the display is chosen to give the wearer adequate time to consult the display to determine the hour and minute of time. Should the minutes (or hours) change during the time display, this change is immediately indicated by advancement of the minute (or hour) reading to the next number, i.e., 11, as the watch is being read. If the push button 18 remains depressed at the end of $1\frac{1}{4}$ second, the hours and minutes of the display are extinguished, i.e., they disappear and simultaneously the seconds reading is displayed through the window 14 by the same diodes which previously displayed the minutes. The advancing seconds cycling from zero to 59 continue to be displayed through window 14 until the push button switch 18 is released.

Push button 18 is a read switch or a demand switch which is depressed when the wearer desires the time to be displayed. Also incorporated in the watch 10 of FIG. 1 is a second push button switch 20 identical in construction and hereafter referred to as the date switch. When the push button 20 of the date switch is depressed, the day of the month, month of the year, and the AM or PM of time are displayed by the same diodes that display time in response to depression of push button 18. A day of the week display such as TU (for Tuesday) appears immediately below on a separate set of light emitting diodes. The date display is preferably timed for $1\frac{1}{4}$ seconds in the same manner as the hours and minutes display.

Figure 3:
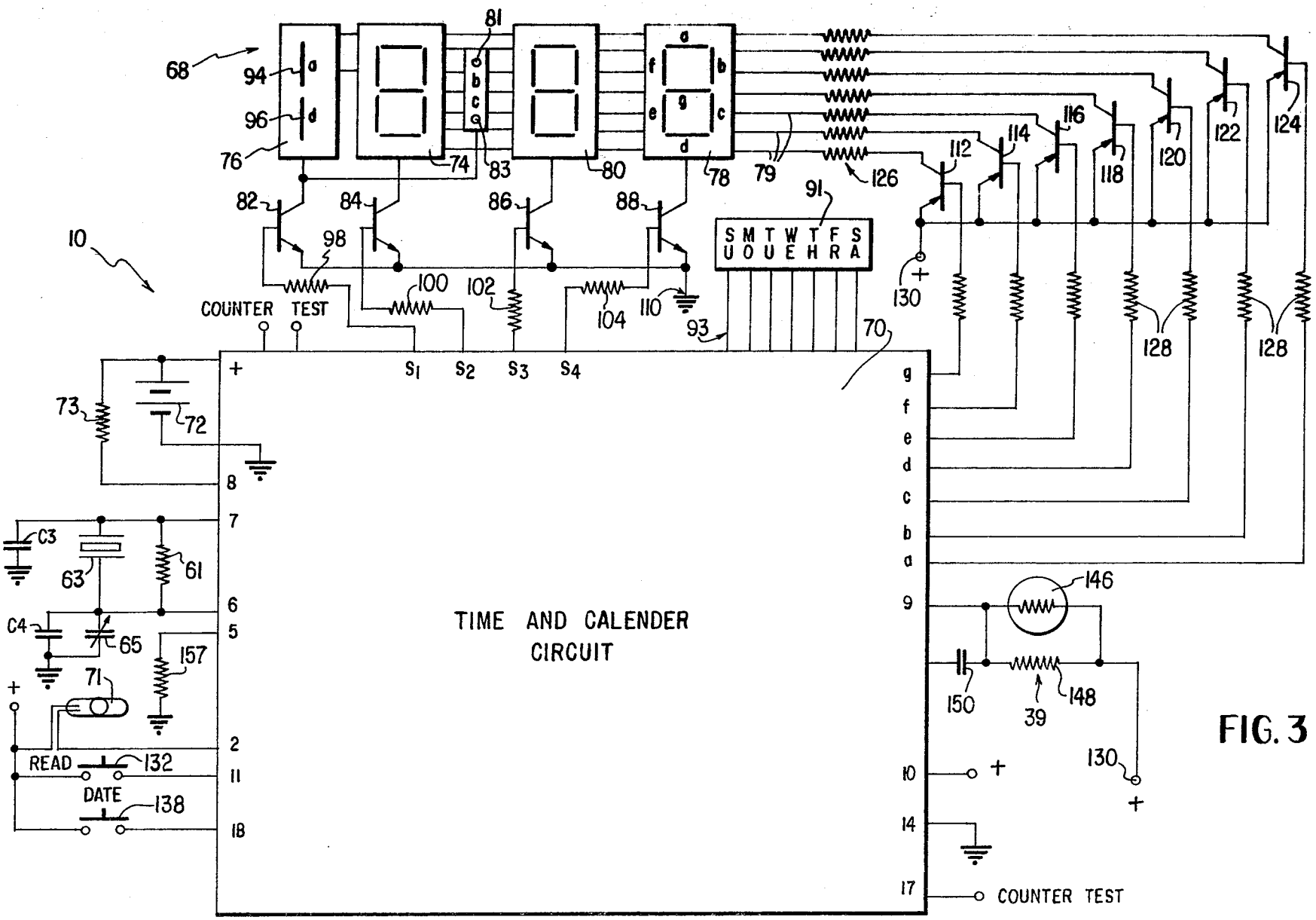
FIG. 3 is a detailed circuit diagram of the wristwatch of this invention with the large scale integrated circuit chip in block form.

FIG. 3 is an overall circuit diagram of the wristwatch of this invention. The watch comprises a large scale integrated circuit 70, preferably in the form of a single integrated circuit formed either of complementary symmetry MOS transistors (CMOS) or integrated injection logic ($I^2L$). In addition to the large scale integrated circuit 70, the watch comprises a battery 72 which by way of example only may comprise a conventional three-volt wristwatch battery formed from two one and one-half volt cells connected in series. The battery energizes the light emitting diode display 68 which is shown in FIG. 2 as consisting of a pair of hours stations comprising the digits station 74 and tens station 76 and a pair of combination minutes and seconds stations comprising the digits station 78 and tens station 80. The display 68 also includes a pair of colon dots 81 and 83, each formed by a single light emitting diode. Station 78 is formed of a seven bar segment array including the light emitting diode segments labeled "*a*" through "*g*". Stations 74 and 80 are of identical construction whereas the hours tens station 76 is formed from two light emitting diode bar segments 94 and 96. The display stations are energized from integrated circuit 70 connected to battery 72 by way of a plurality of leads 79 to the anodes of the light emitting diodes and the cathodes of the light emitting diodes are individually connected to the other side of the power supply through strobing or switching NPN junction transistors 82, 84, 86 and 88. There is a separate lead 79 for the total number of bar segments in a display station and these leads are connected to a corresponding "*a*" through "*g*" segment of each of the stations 74, 78, and 80. That is, with a seven bar segment display, there are seven leads 79. However, all of the cathodes of each station are connected in common through the NPN junction transistor for that display. The two bar segments 94 and 96 for the hours tens display have their cathodes connected to the transistor 82 as do the colon dots 81 and 83. All the cathodes of hours units stations 74 are connected to transistor 84. Display stations 78 and 80 are used to display both minutes and seconds and station 80 has the cathodes of all diodes connected to the transistor 86 and all the cathodes of display station 78 are similarly connected to transistor 88. These transistors have their bases returned to the integrated circuit 70 through current limiting resistors 98, 100, 102 and 104, the emitters of the transistors being connected in common to ground, i.e., the negative side of the power supply battery 72 as indicated at 110.

The anodes of the bar segment diodes are energized from the bipolar driver transistors 112, 114, 116, 118, 120, 122 and 124. Since the greatest number of bar segments in any display station is seven, there are seven driver transistors and seven leads 79. The transistor collectors are connected to the display diodes through individual current limiting resistors 126 and the driver transistor bases are connected to the integrated circuit 70 through protective resistors 128. The emitters of the driver transistors are connected in common to the positive side 130 of power supply battery 72. The PNP segment driver transistors are preferably formed from a transistor array as are the NPN strobing transistors.

The crystal oscillator or frequency standard by way of example only may be of the type disclosed in assignee's U.S. Pat. No. 3,760,584. The components of this oscillator in FIG. 2 external to the large scale integrated circuit 70 are the crystal 63, the variable capacitor 65 (tuning capacitor or trimmer), bias resistors 61, 73 and 157, and the *pi* network feedback capacitors C3 and C4, as illustrated. The circuit of the patent is modified in FIG. 2 to the extent that the variable capacitor 65 is connected in parallel with grounded feedback capacitor C4. The remaining portions of the oscillator 56 are incorporated in the integrated circuit 70 of FIG. 2 as more fully described below. Also external to the integrated circuit is a demand or time read switch 132 which is closed when the button 18 of FIG. 1 is depressed and the date read switch 138 which operates when button 20 is depressed.

In the watch of the present invention, the intensity of the light emitted from the display diodes is varied in accordance with ambient light. That is, the diode light intensity is increased for greater contrast when the ambient light is bright, such as during daytime display, whereas the intensity of the light from the diodes is decreased when ambient light decreases. The automatic display intensity control circuitry is generally indicated at 39 in FIG. 3 and comprises a photosensitive resistor 146 suitably mounted on the face of the watch connected to the positive side of battery 72 and to a resistor 148 and a capacitor 150. If desired, the watch may include an inertial switch 71 in parallel with the read switch 132.

Shown in FIG. 3 is a separate day of the week display 91 connected to a day of the week circuit by the seven leads 93. This circuit may be separate from or integral with the time and calendar chip 70. A detailed description of a circuit and display of this type is given in assignee's co-pending application Ser. No. 706,013 filed July 16, 1976, the disclosure of which is incorporated herein by reference.

Figure 4:
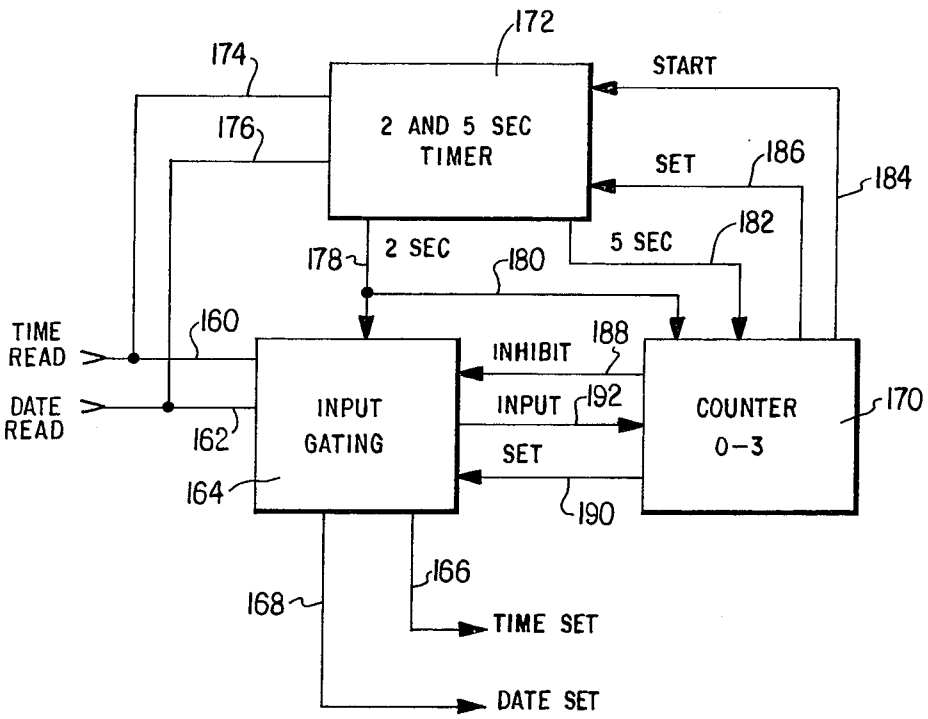
FIG. 4 is a simplified block diagram of the conditioning circuit portion of the setting system of this invention.

FIG. 4 is a simplified block diagram of the conditioning circuit portion of the new setting system of the present invention. The time read input resulting from the closure of switch 132 in FIG. 3 and the date read input resulting from the closure of switch 138 appear in FIG. 3 on the respective leads 160 and 162 and are applied to an input gating circuit. This circuit in turn produces a time set signal on lead 166 and a date set signal on lead 168. Input gating circuit 164 is in turn connected to a zero to three counter 170 and to a two and five second timer 172 as illustrated.

In FIG. 4, the time and date inputs are connected to the timer 172 by leads 174 and 176. This produces a two second output on lead 178 which is applied to the input gating circuit 164 and by way of a lead 180 to the counter 170. Timer 172 also supplies a five second impulse or signal by way of a lead 182 to the counter 170. The counter in turn supplies a start signal to the timer by way of a lead 184 and a set signal by way of a lead 186. Counter 170 supplies inhibit and set signals to the input gating circuit 164 by way of leads 188 and 190 and receives an input from the gating circuit over lead 192.

Figure 5:
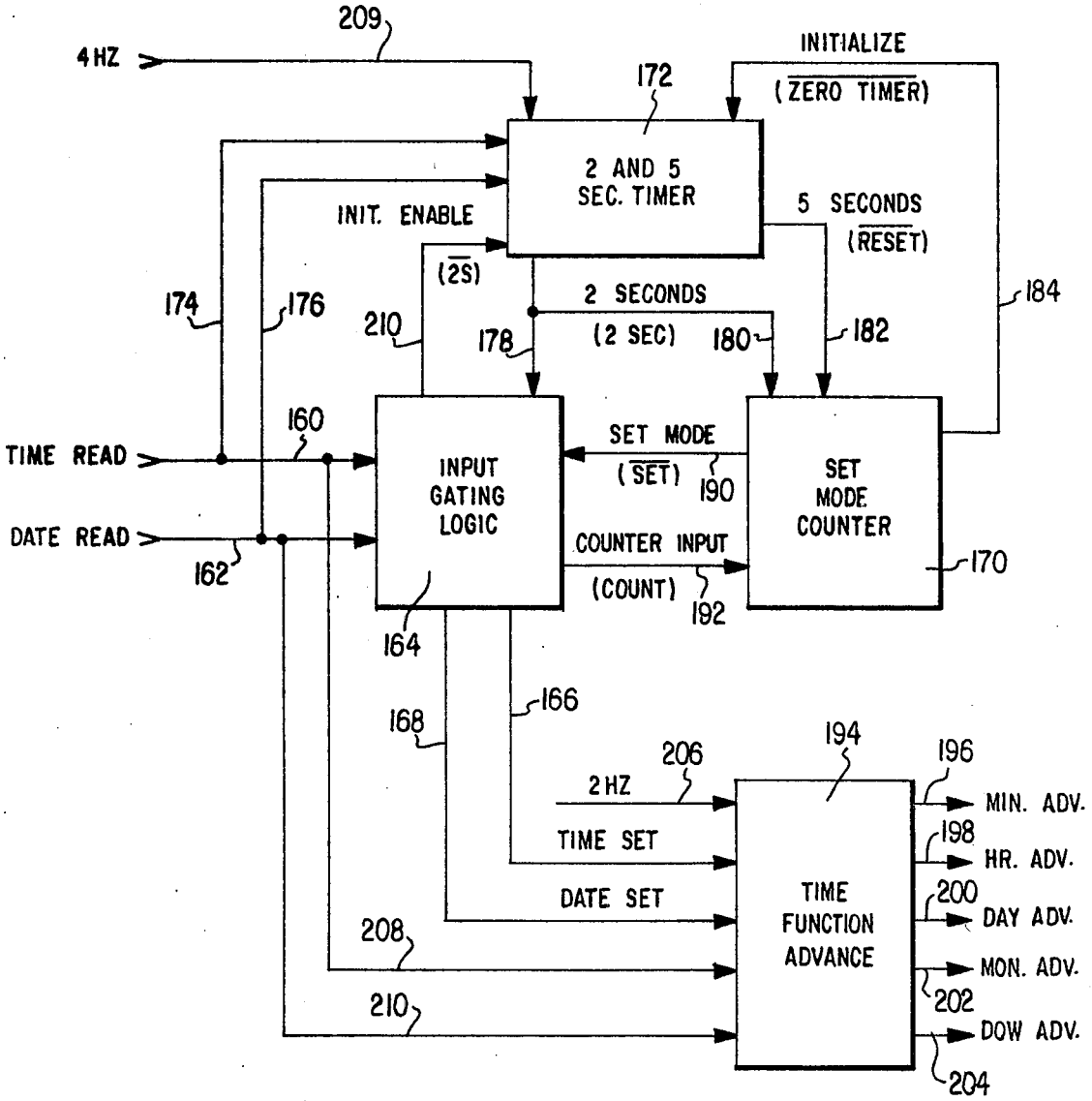
FIG. 5 is a more detailed block diagram of the setting system of this invention.

FIG. 5 is a more detailed block diagram of the programmable setting system of this invention in which like parts bear like reference numerals. The principal difference in FIG. 5 over FIG. 4 is the addition of the time function advance circuit 194 which shows all five outputs necessary for setting a full function wristwatch. These are the minute advance output 196, the hour advance output 198, the day advance output 200, the month advance output 202, and the day of the week advance output 204. The time function advance circuit 194 connects a 2 Hz. setting signal taken from the appropriate stage of the divider in the time and calendar circuit 70 of FIG. 3 as appears on leads 206 in FIG. 5 and connects this setting signal to the appropriate one of the five outputs described immediately above to advance the corresponding register at the rate of 2 Hz. until the desired setting is reached. Time read and date read signals are applied to the time function advance circuit 194 over leads 208 and 210. Additional features in FIG. 5 show a 4 Hz. signal input on lead 209 to the trimmer 172, again taken from the conventional binary divider forming a part of the chip 70 and an initialize enable lead 211 connecting the gating circuit 164 to the timer 172.

FIG. 6 is a detailed logic diagram of the two second and five second timer 172. The time read and date read input on leads 160 and 162 are applied through a NOR gate 210 and 212, respectively, to an input of a NAND gate 214. These latter two gates receive respectively the complements of the 2 second 2S signal or initialization enabling signal from the input gating logic and the complementary zero timer or initialize signal from the set mode counter on leads 210 and 184, respectively. NAND gate 214 supplies an output by way of a lead 216 to the reset terminals of a series of five flip-flops 218, 220, 222, 224 and 226 forming a five-stage binary counter. The 4 Hz. signal is applied to the $\phi$ input of the first stage 218 and to the $\overline{\phi}$ input through an inverter 228. The 2 second signal is taken from the output of the fourth stage, i.e., 4 Hz. divided by 8 and appears on lead 178. The five second signal appears at output 182 and is derived from the output of the third and fifth stages of the counter through NAND gate 230. In addition to the 2 second output is a 1.25 second output on a lead 232 which is derived from the $\overline{Q}$ outputs of the first and third stages by way of a NOR gate 234.

FIG. 7 is a detailed logic diagram of the set mode counter 170 which comprises in essence a pair of flip-flops 236 and 238, receiving a count input over the lead 192. The set complement output is derived from the two flip-flops by way of a NAND gate 240. Control logic for the counter includes a two input NAND gate 242 connected to the flip-flops, a three input NAND gate 244 connected to the output of gate 242, to the set complement output by way of a lead 246 and to the two second input on lead 180. The output of this NAND gate and the reset complement signal on lead 182 are connected to the flip-flops through a third control logic NAND gate 248.

Figure 8:
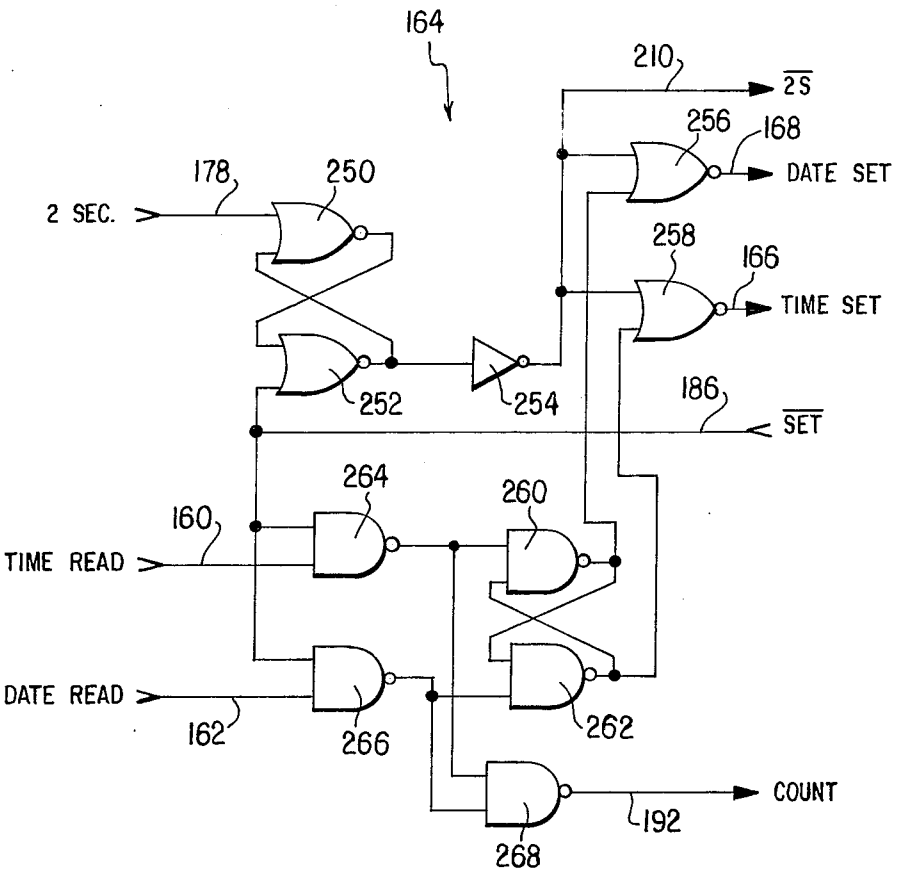
FIG. 8 is a detailed logic diagram of the input gating logic circuit of FIG. 5.

FIG. 8 is a detailed logic diagram of the input gating logic circuit 164. The two second input on lead 178 is applied to cross-coupled NOR gates 250 and 252, and the output of this flip-flop is connected through an inverter 254 to NOR gates 256 and 258 producing the date set and time set output on leads 168 and 166. These gates are also connected to the outputs of cross-coupled NAND gates 260 and 262 which receive the time read and date read signals on leads 160 and 162 by way of two additional NAND gates 264 and 266. These latter produce the count output on lead 192 by way of an additional NAND gate 268.

Figure 9:
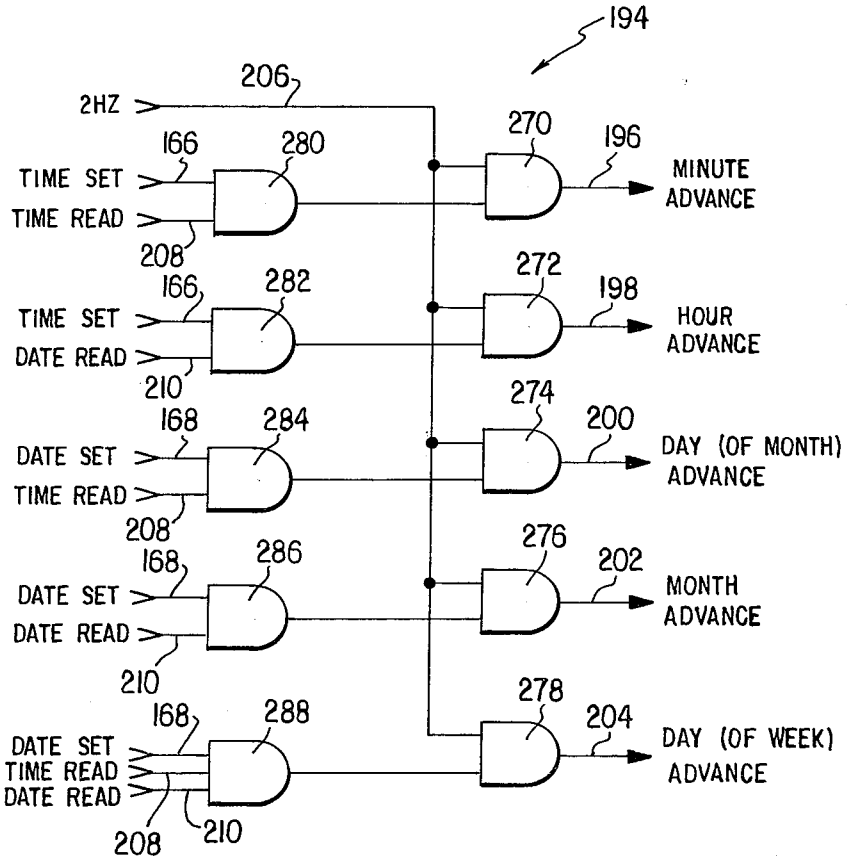
FIG. 9 is a detailed logic diagram of the time function advancing logic circuit of FIG. 5.

FIG. 9 is a detailed logic diagram of the time function advance circuit 194. The five outputs 196, 198, 200, 202 and 204 previously described, appear at the output of the respective AND gates 270, 272, 274, 276 and 278, respectively. These gates connect the 2 Hz. advance signal on lead 206 to the respective output. Time set and time read signals on lead 166 and time read signals on leads 208 pass through an AND gate 280 to the minute advance gate 270. Time set and date read signals on leads 166 and 210 pass through AND gate 282 to the hour advance gate 272. Date set and time read signals on leads 168 and 208 pass through AND gate 284 to the day of month advance gate 274. Date set and date read signals on leads 168 and 210 are connected through AND gate 286 to the month advance gate 276. Finally, three signals, namely a date set signal on lead 168, a time read signal on lead 208 and a date read signal on lead 210 are connected through AND gate 288 to the day of week advance gate 278.

In operation there are two general setting modes for changing the time and data readings in the watch circuit. These are TIME SET which is used for setting the minutes or hours and DATE SET which is used for setting days or months or days of the week.

The TIME SET mode is generated by applying a Time Read input three successive times to the watch circuit within a 1 second interval. This is done by three successive depressions of time demand button 18 in FIG. 1. The watch circuit indicates this setting mode by displaying the hour and minute continuously while in the TIME SET mode. Minutes may then be advanced by applying and maintaining the Time Read signal or hours may be advanced by applying and maintaining the Date Read input. The circuit will automatically vacate the TIME SET mode at the end of any 5 second intervals during which no Time Read or Date Read input has been received. Upon leaving the setting mode the circuit will revert to the normal operating mode.

The DATE SET mode is generated by applying a Date Read input three successive times to the watch circuit within a two second interval. This is done by corresponding depressions of date demand button 20. The watch circuit indicates this setting mode by displaying the month and day or month, day, and day of the week continuously while in the DATE SET mode. Days may then be advanced by applying and maintaining the Time Read input and months may be advanced by applying and maintaining the Date Read input. The days of the week may be advanced by applying and maintaining both Time Read and Date Read inputs.

The circuit will automatically vacate the DATE SET mode at the end of any 5 second intervals during which no Time Read or Date Read input has been received. Upon leaving the setting mode the circuit will revert to the normal operating mode.

The block diagram shown in FIG. 4 divides the Programmable Setting System into three principal sections; the 2 and 5 second timer 172; set mode counter 170, and input gating logic 164. The 2 and 5 second timer as shown in FIG. 6 consists of a five stage counter operating from a watch oscillator referenced 4 Hz. clock and its associated logic gates. The inputs to this section are TIME READ, DATE READ, $\overline{2S}$, $\overline{\text{ZERO TIMER}}$, and 4 Hz. The outputs are 2 SEC, $\overline{\text{RESET}}$, and a 1.25 SEC signal for other watch logic. The TIME READ and DATE READ inputs reset the timer section while the unit is in the set mode. The $\overline{2S}$ input is low while in the set mode and is used to enable TIME READ and DATE READ to reset the timer. The input $\overline{\text{ZERO TIMER}}$ holds the timer in the reset condition whenever the Set Mode Counter is in state 0. The 4 Hz. input is the clock used to generate the two second and five second timing intervals. The output 2 SEC goes high two seconds after $\overline{\text{ZERO TIMER}}$ is released (goes high). The output $\overline{\text{RESET}}$ goes low 5 seconds after $\overline{\text{ZERO TIMER}}$ goes high or after a TIME READ or DATE READ pulse input is received.

The set mode counter shown in FIG. 7 consists of a two stage counter and associated decoding logic gates. The inputs to this section are COUNT, 2 SEC, and $\overline{\text{RESET}}$. The outputs are $\overline{\text{SET}}$ and $\overline{\text{ZERO TIMER}}$. The COUNT input goes directly to a two flip-flop counter and each pulse in advances the counter one state (possible states are 0, 1, 2, and 3). The input 2 SEC resets the two stage counter to state 0 whenever the counter begins counting but fails to advance to the 3 state within 2 seconds. The input $\overline{\text{RESET}}$ resets the two stage counter to state 0 whenever the 5 stage second timer times out. The output $\overline{\text{SET}}$ signifies the unit is in the set state (counter advances to state 3 within two seconds) whenever this signal is low. The output $\overline{\text{ZERO TIMER}}$ goes low whenever the two stage counter is in the 0 state.

The input gating logic circuit of FIG. 8 consists of logic gates to generate the outputs $\overline{2S}$, DATE SET, TIME SET, and COUNT in response to the inputs TIME READ, DATE READ, 2 SEC, and $\overline{\text{SET}}$. The output $\overline{2S}$ is asserted low whenever $\overline{SET}$ is low upon receiving the input 2 SEC. The output pulse COUNT is generated whenever a TIME READ or DATE READ pulse input is received as long as the unit is not in the set mode ($\overline{SET}$ is high). The outputs DATE SET and TIME SET are asserted only when in the set mode. If three COUNT pulses were achieved within the two second timing window, then TIME SET or DATE SET are asserted high when the third COUNT pulse was TIME READ or DATE READ, respectively.

The system is assumed to be in its initialized state. This means the set mode counter 170 is in state 0 and $\overline{ZERO\ TIMER}$ is low, thus holding the timer section 172 in a reset condition. When a TIME READ or a DATE READ pulse is received, the set mode counter 170 receives a COUNT pulse and advances to state 1. This state forces $\overline{ZERO\ TIMER}$ high and releases the 2 second timer to being counting. If another TIME READ or a DATE READ pulse is received within 2 seconds of the first pulse, the set mode counter 170 advances to state 2, but no other actions occur. If no more TIME READ or DATE READ signals occur by the time 2 SEC goes high (means 2 seconds have elapsed since the initial signal), the set mode counter is reset to state 0 by 2 SEC thus forcing $\overline{ZERO\ TIMER}$ low and resetting the timer section to its initialized state. If, however, a third TIME READ or DATE READ pulse is received before the 2 SEC signal goes high, the COUNT pulse advances the set mode counter 170 to state 3 and $\overline{SET}$ goes low. This $\overline{SET}$ now will inhibit further TIME READ or DATE READ pulses from generating COUNT signals and also inhibits the 2 SEC signal from initializing the whole system. When 2 SEC does go high (after $\overline{SET}$ goes low) either DATE SET or TIME SET is asserted depending on whether the third pulse received was DATE READ or TIME READ, respectively. Activating time read and/or date read will then initiate setting sequences in the remaining watch circuits. If no TIME READ or DATE READ signals occur for any 5 second period, the 5 second timer will time out and assert $\overline{RESET}$ low. This signal resets the set mode counter 170 and the system is initialized. Each time TIME READ or DATE READ is asserted while in the set mode, the 5 second timer is reset and a new 5 second timing period is started.

The signals TIME SET and DATE SET are used in the watch circuit for advancing specific timing keeping parameters. This is shown logically in FIG. 9. For example, in TIME SET mode, activating DATE READ advances hours at a 2 Hz. rate, and activating TIME READ advances minutes at a 2 Hz. rate (seconds is reset to 00 and held until the set mode is vacated and TIME READ is activated). In DATE SET mode, activating DATE READ advances months at a 2 Hz. rate, activating TIME READ advances days of month at a 2 Hz. rate, and activating both simultaneously advances days of the week at a 2 Hz. rate.

Following is a description of a typical setting operation which may be followed by the wearer of the watch. Each of the time and calender or date functions is set independently. Month and date settings are initiated with the date command buttons whereas the hours, minutes and seconds with the time command button 18. When the watch is first set, it is preferred that it be in the following order (1) month, (2) date, (3) hour and AM/PM indication, and (4) minute and second.

In order to set the month, the month/day button 20 is pressed three times in rapid succession to activate the month reset mode. The button is released for a second or two and then, while the display is still lit, pressed again and held to advance the month figure to the desired setting. The month button is released when the month setting is correct. In this case, the display turns off automatically.

The reset display will remain lit for five seconds after the date button 20 is released. If the wearer desires to change the date at this time, it can be done by pressing the time command button 18 while the display is still lit. The button is released when the day setting is correct and the display will turn off automatically indicating that the correct month and date are "locked" into the watch.

In order to set the date and AM/PM indicator, the month/date demand button 20 is pressed three times in rapid succession to activate the date and AM/PM reset mode. The button is released with a pause of a second or two. While the display is still lit, the operator presses and holds the time button 18 to advance the date figure to the desired setting. The AM/PM indicator colon dots will flash alternately with each successive change. The button is released when the date setting and the AM/PM indication are correct and the display will turn off automatically. The reset date display will remain lit for five seconds after the time demand button 18 is released. If the wearer wishes to change the month at this time, it can be done by pressing the month/date button 20 while the display is still lit. This button is released when the month setting is correct and the display will turn off automatically indicating that the month, date, and AM/PM indications are "locked" into the wristwatch.

Hour setting is accomplished by pressing the time demand button 18 three times in rapid succession to activate the hour set mode. Again, after a pause of a second or two, and while the display is still lit, the wearer presses and holds the month/date demand button 20 to advance the hour figure to the desired setting. This button is released when the hour setting is correct and the display automatically turns off. The reset hour display will remain lit for 5 seconds after the button is released. If the wearer wants to change the minute setting as well, this can be done by pressing the time demand button 18 while the display is still lit. The button is released when the minutes setting is correct. The display will turn off automatically indicating that the hour and minute resets are completed and that the seconds display is "locked" in at 00. Nothing happens at this time until the wearer presses the time demand button 18 again which "unlocks" the seconds and reactivates the chip.

When setting the minutes and seconds, it is desirable to first choose an accurate time source such as a radio or television signal or preferably a local telephone company time signal. In order to provide for precise synchronization, the wearer should select a minute and seconds setting to coincide with an upcoming signal. Any minute reset, even a one minute adjustment automatically recycles and locks in the seconds at 00. To set the minutes, the wearer presses the time demand button 18 three times in rapid succession to activate the minute reset mode. After a release and pause of a second or two and while the display is still lit, the button is again pressed and held to advance the minute figure to the desired setting. Release of the button when the setting is correct permits the display to turn off automatically. Nothing happens at this time until the wearer presses the time demand button 18 again which "unlocks" the seconds and reactivates the watch. The reset minute display will remain lit for 5 seconds after the button is released. If the wearer wishes to change the hour setting at this time, it can be done by pressing the month/date demand button 20 while the display is still lit. When the button is released with the hour setting at the correct figure, the display will turn off automatically indicating that hour and minute resets are completed with the seconds displate "locked" in at 00. Nothing happens at this time until the wearer presses the time demand button 18 again which "unlocks" the seconds and reactivates the wristwatch.

To reset the seconds, it is necessary to first advance the minute display at least one figure to activate the second reset mode. Advancing the minutes even just 1 minute automatically recycles the seconds and "locks" them in at 00. When the minute reset coincides with the upcoming time signal or master time source, the wearer presses the time demand button 18 once to "unlock" the seconds beginning at 00. The watch is now reactivated and functioning normally. As can be seen from the above, each function can be reset independently, as well as in related combinations of month/date or hours/minutes. If the wearer inadvertently presses either button three times in rapid succession, the display will light, hold for 5 seconds, and then go out. No function will change and the wearer has not affected any setting nor altered the performance of the wristwatch under these circumstances in any way.

It is apparent from the above that the present invention provides a simplified and improved setting arrangement for a light emitting diode calender wristwatch which eliminates the need for the customary additional hour and minute setting switches. There is no necessity for a separate permanent magnet and all setting is effected through a pair of push button permanent magnet switches which do not penetrate the wristwatch case from the outside and therefore minimize sealing problems. A separate permanent magnet need not be carried by the wearer and there is no necessity for a magnet compartment in the wristwatch, wrist bank, or clasp as in previous constructions. Setting is simple and has the added advantage that it may be accomplished without removing the watch from the wearer's wrist.

The invention may be embodied in other specific forms without departing from the spirit or essential characteristics thereof. The present embodiment is, therefore, to be considered in all respects as illustrative, and not restrictive, the scope of the invention being indicated by the appended claims rather than by the foregoing description, and all changes which come within the meaning and range of equivalency of the claims are, therefore, intended to be embraced therein.

What is claimed and desired to be secured by U.S. Letters Patent is:

1. A solid state wristwatch comprising a source of substantially constant frequency electrical signals, a divider coupled to said source for reducing the frequency of the electrical signals, a display actuator coupled to said divider for producing both time and date electrical signals, an active digital display coupled to said actuator, a manually operated time demand switch in said watch for coupling time information from said actuator to said display, a manually operated date demand switch in said watch for coupling date information from said actuator to said display, a source of setting signals in said watch, and means responsive to multiple actuations of at least one of said switches within a predetermined time period for coupling said source of setting signals to said display.

2. A wristwatch according to claim 1 wherein said switches comprise a pair of push buttons.

3. A wristwatch according to claim 2 wherein said means responsive to actuations of at least one of said switches comprises a conditioning circuit which is converted from a demand mode into a setting mode by said multiple actuations.

4. A wristwatch according to claim 3 wherein said conditioning circuit automatically converts back to said demand mode if no further actuation of at least one of said switches occurs within a second predetermined time period.

5. A wristwatch according to claim 4 wherein the first recited time period is of 2 seconds duration.

6. A wristwatch according to claim 5 wherein said means responsive to multiple actuations places said conditioning circuit in a setting mode in response to three actuations within said 2 second time period.

7. A wristwatch according to claim 6 wherein said actuation responsive means is responsive to three actuations of either of said switches.

8. A wristwatch according to claim 7 wherein said conditioning circuit is selectively converted to a setting mode for setting a different portion of said display dependent upon which switch is actuated within said 2 second time period.

9. A wristwatch according to claim 8 wherein said second predetermined time period is 5 seconds.

10. A solid state wristwatch comprising a quartz crystal oscillator acting as a substantially constant frequency time base, a frequency divider coupled to said time base for reducing the frequency of the electrical signals, a display actuator coupled to said divider for producing both time and date electrical signals, a light emitting diode digital display coupled to said actuator, a push button time demand switch on said watch for coupling time information from said actuator to said display, a push button date demand switch on said watch for coupling date information from said actuator to said display, means coupled to said frequency divider for developing a source of display setting signals, a conditioning circuit for coupling said setting source to said display when one of said buttons is depressed and held down, said conditioning circuit normally blocking said setting source from said display but being convertable into a setting mode for transmitting setting signals from said setting source to said display in response to multiple depressions of one of said push buttons within a predetermined time interval.

11. A wristwatch according to claim 10 wherein said conditioning circuit includes means for automatically reverting to a setting signal blocking mode if neither of said push buttons is depressed within a predetermined time period after conversion into said transmitting mode.

12. A wristwatch according to claim 11 wherein said display is set by a continuous setting signal at a frequency of at least 1 Hz. as long as one of said buttons is depressed after conversion into said setting mode.

13. A wristwatch according to claim 12 wherein said display comprises hours, minutes, day of the month, month of the year, and day of the week displays.

14. A wristwatch according to claim 13 wherein each of said displays is independently settable.

15. A wristwatch according to claim 14 wherein said wristwatch also includes a seconds display and an AM/PM display.

16. A wristwatch according to claim 15 wherein said seconds display is set in conjunction with said minutes display and said AM/PM display is set in conjunction with said day of the month display.

17. A wristwatch according to claim 12 wherein said conditioning circuit comprises a gating circuit for normally blocking a setting signal from said display, a counter circuit coupled to said gating circuit, and a two interval timer coupled to both said gating circuit and said counter.

18. A wristwatch according to claim 17 wherein said counter counts to three.

19. A wristwatch according to claim 17 wherein said timer is a 2 second and a 5 second timer.

20. A wristwatch according to claim 17 including a time function advance circuit coupled to said gating circuit.

* * * * *